US005246343A

United States Patent [19]

Windsor et al.

[11] Patent Number: 5,246,343

[45] Date of Patent: Sep. 21, 1993

[54] FAN ASSEMBLIES AND METHOD OF MAKING SAME

[75] Inventors: Jim Windsor, Mequon, Wis.; Chuck Straight, Overland Park; Samir Khouzam, Lenexa, both of Kans.

[73] Assignee: Emerson Electric Co., St. Louis, Mo.

[21] Appl. No.: 811,652

[22] Filed: Dec. 23, 1991

[51] Int. Cl.[5] ..... B63H 1/20

[52] U.S. Cl. ..... 416/210 R; 416/213 A; 416/DIG. 3; 416/223 R; 416/DIG. 2; 416/DIG. 5

[58] Field of Search ..... 416/223 R, 213 R, 213 A, 416/DIG. 2, DIG. 5, 204 R, 210 R

[56] References Cited

U.S. PATENT DOCUMENTS

| | | | |
|---|---|---|---|
| 2,974,728 | 3/1961 | Culp | 416/DIG. 3 |
| 3,951,611 | 4/1976 | Morrill | 416/DIG. 3 |
| 4,053,260 | 10/1977 | Yee | 416/DIG. 3 |
| 4,088,423 | 5/1978 | Dulin et al. | 416/DIG. 3 |
| 4,120,257 | 10/1978 | Matucheski | 416/DIG. 3 |

FOREIGN PATENT DOCUMENTS

| | | | |
|---|---|---|---|
| 7733 | 10/1907 | France | 416/223 |
| 0715828 | 2/1980 | U.S.S.R. | 416/223 R |

OTHER PUBLICATIONS

Owczarski, W. A., "Getting The Most From Projection Welding", *Machinery*, vol. 69, No. 2, Oct. 1962, pp. 97-100.

*Primary Examiner*—Thomas E. Denion

*Attorney, Agent, or Firm*—Polster, Lieder, Woodruff & Lucchesi

[57] ABSTRACT

A low cost assembly and method for assembly of a fan having a hub, a spider with arms and blades attached to the arms is provided. The spider is arc welded to the hub and the blades are projection welded to the arms. The blades have a root, a tip, and an ear. The width or chord of the blade decreases from the root to the ear and then increases from the ear to the tip. The blade has an air foil shape defined by the arcs of two circles. The radii of the circles and, thus the profile of the blade, change as a function of the cord length and the camber of the blade. The blades have a pitch angle which decreases from the root to the ear. The spider arms are formed to match the pitch and are rotated slightly with respect to the horizontal. The result is a highly efficient, low cost fan blade assembly construction.

15 Claims, 4 Drawing Sheets

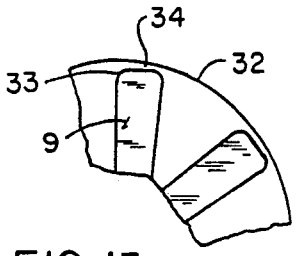
FIG. 15.
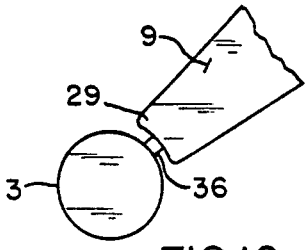
FIG. 16.
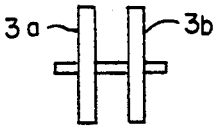
FIG. 17.
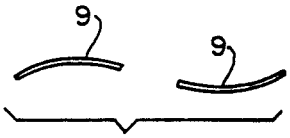
FIG. 19.
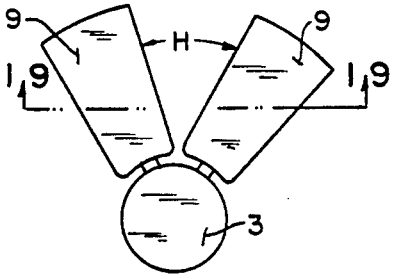
FIG. 18.
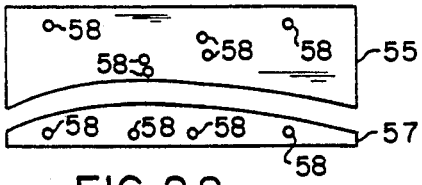
FIG. 22.
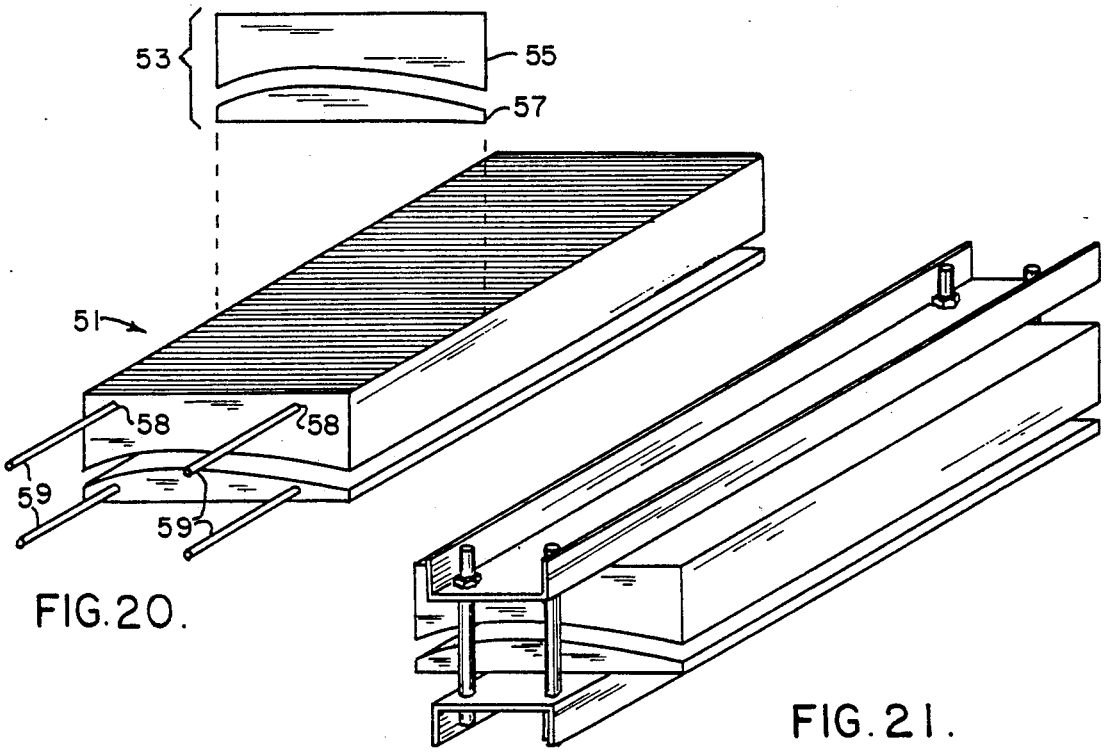
FIG. 20.
FIG. 21.

FAN ASSEMBLIES AND METHOD OF MAKING SAME

BACKGROUND OF THE INVENTION

This invention relates to fan blade assemblies and in particular, to a more efficient fan assembly and a method of making the same.

Whenever natural ventilation is unsuitable, as for example in large office blocks, industrial buildings, or where toxic fumes or harmful dusts are released, mechanical ventilation is necessary. The fans employed, conventionally are driven by electric motors, are broadly classified according to their action on the air, as axial or centrifugal fans. Axial fans cause air to move substantially parallel to the axis of the fan. A fan assembly typically consists of an annular hub, a hub plate or spider having arms attached to the hub and fan blades secured to arms of the spider. The hub in turn is attached to a shaft which is connected with two pulleys and a belt to the motor. The fan blades are typically secured to the spider arms by rivets. The main characteristic of axial flow fans is that for a given power output from a driving motor, they can handle large volumes of air, especially when flow is relatively unobstructive. When, however, there is resistance to air flow, recirculation or backward flow may occur through the fan itself, owing to the inablility of slower moving parts of the blades close to the hub to equal the pressure caused nearer the blade tips were circumferential speed is the greatest. Such resistance can be caused, for example, by filters, heaters, or long or circuitious runs of ducting. In these kinds of applications, the operating conditions produce large shear and tension forces which eventually cause the rivets holding the fan blades to the spider arms to wear out. Blade detachment destroys fan operability. Repair is difficult in many applications and generally expensive to accomplish.

By studying the effect of the parameters which effect fan performance, an efficient fan can be designed. These parameters include blade shape, number of blades, and spacing between the blade and the fan hub and between the blade and the fans associated venturi. It is known that fan efficiencies increase if the fan blade is curved. However, when a curve is put into the blade, the blades often spring back, especially if made from a metal. In other words, the blade recovers some of its original shape after being formed in a die. This is especially true where cost is a consideration. That is, efficient blade designs are well known in the art. Their construction, however, are expensive. Our invention permits a manufacture to make, in a high production, low cost environment , a highly efficient, relatively low cost fan.

SUMMARY OF THE INVENTION

One object of the present invention is to provide an efficient fan assembly.

Another object is to provide a blade, which when placed in the fan assembly will, produce a fan assembly having high efficiency.

Another object is to provide formed blades for a fan assembly which do not spring back after forming.

Another object of the invention is to provide a fan assembly having a long life.

Another object is to provide a method for producing a fan assembly inexpensively.

These and other objects will become apparent to those skilled in the art in light of the following disclosure and accompanying drawings.

In accordance in the invention, generally stated, a fan assembly is provided having low cost and improved efficiency. The fan assembly includes an annular hub which fits over a shaft and is connected to a motor shaft for rotation therewith, a spider fixed to the hub, the spider having a plurality of arms, and a plurality of fan blades fixed to the spider arms. The blades have a root section, a tip section, and an ear section between the tip and root. The blade is formed as an arc defining a chord which decreases along the root section and increases from the ear to the tip. The blade has a blade depitch angle which decreases from the root to the tip and a camber which is kept constant as a percent of the chord. The camber is from about 6% to about 12.5% of the chord. preferably, the camber is from about 7%–9% of the chord and it is most preferably about 8% of the chord. The blade depitch angle preferably decreases at a rate of about 1.5° per inch to 3° per inch. The blades have a pitch angle of between 22.5° and 40° . Preferably, the tip pitch angle is between 22.5° and 35° . For depitched blades, the pitch angle is preferable between 27.5° and 30° . The chord length preferably decreases by about 0.15″ per inch from the root to the ear section and increases by about 0.177″ per inch from the ear to the tip. The arc which defines the profile of the blade is defined by arcs of two circles, one arc defining $\frac{1}{3}$ of the chord length, the other arc defining $\frac{2}{3}$ the chord length. The arcs which define the profile of the blade have radii which change along the length of the blade. The radii are determined-as a function of the camber and the chord length.

The hub plate arms preferably have a rib on one face extending the length thereof and a plurality of projections on another face. The ribs aid in avoiding natural modes. If modes are encountered during operation, excessive vibrations may result which may cause the blade to fail. The projections define a securing area on the arm where the blades are secured to the arms.

The hub plate arms are preferably formed to match the pitch of the fan blades. Further, the hub plate arms are preferably rotated approximately 5° toward their leading edge. This slight rotating of the arm aids in increasing the fans efficiency.

The assembly is preferably formed by arc welding the spider to the hub and projection welding the fan blades to the spider arms.

A method of forming fan blades for use in a fan assembly which will enable prediction and control of spring back is also disclosed.

BRIEF DESCRIPTION OF THE FIGURES

FIG. 15 is a fragmentary plan view of a fan showing a blade tip gap between a blade and a venturi;

FIG. 16 is a view similar to that of FIG. 15 showing a gap between the blade root and hub;

FIG. 17 is a side elevational view of a multi-stage hub assembly;

FIG. 18 is a plan view of the fan showing the blade spacing;

FIG. 19 is a cross-sectional view taken along line 19—19 of FIG. 1B, showing the relative positioning of fan blades used for testing the multi-stage hub assembly;

FIG. 20 is a perspective view of a slice die used to form the prototype fan blades;

FIG. 21 is a perspective view of the die being held together; and

FIG. 22 is a plan view of a piece of the slice die which allows for the use of the same die to form blades having varying profiles along their lengths.

DESCRIPTION OF THE PREFERRED EMBODIMENT

Figure 1:
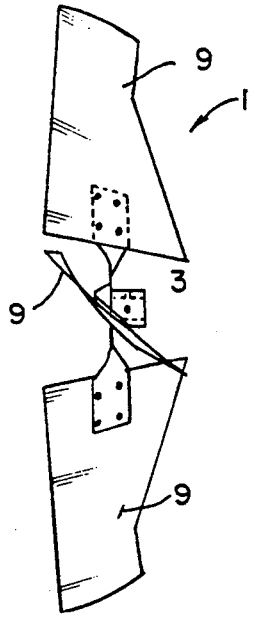
FIG. 1 is a side elevational view of a fan assembly of the present invention.
Figure 2:
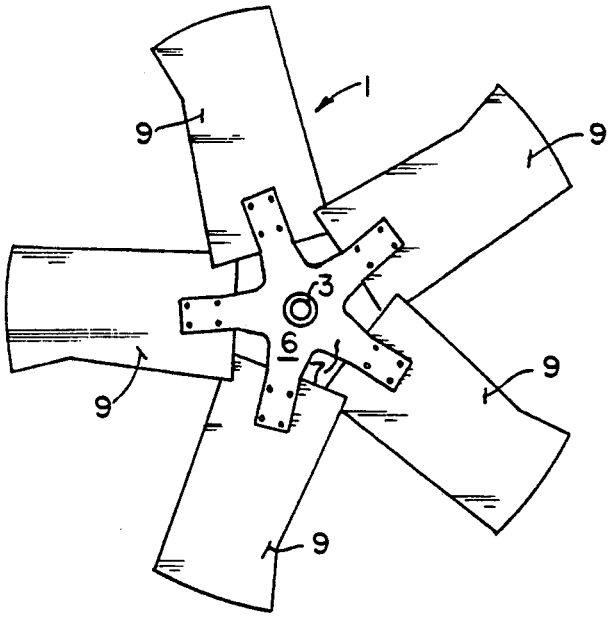
FIG. 2 is a top plan view of the fan assembly of FIG. 1.

Referring initially to FIGS. 1–4, reference numeral 1 indicates one illustrates embodiment of fan assembly of this invention. Fan assembly 1 embodies a hub 3, a spider or hub plate 6 secured to the hub 3, a plurality of spider arms 7 extending from the plate 6, and a plurality fan blades 9, which are secured to the arms 7. As is explained below, the configuration of fan assembly 1 was determined through testing of many variables which effect fan efficiencies.

The blades are preferably made of HRPO continuous cast steel. They vary in thickness depending on the size of the blade. For fans such as 24"–36" fans, the blades preferably are 16 gauge. For fans such as 42" and 48" fans, the blades are preferably 14 gauge.

Figure 3:
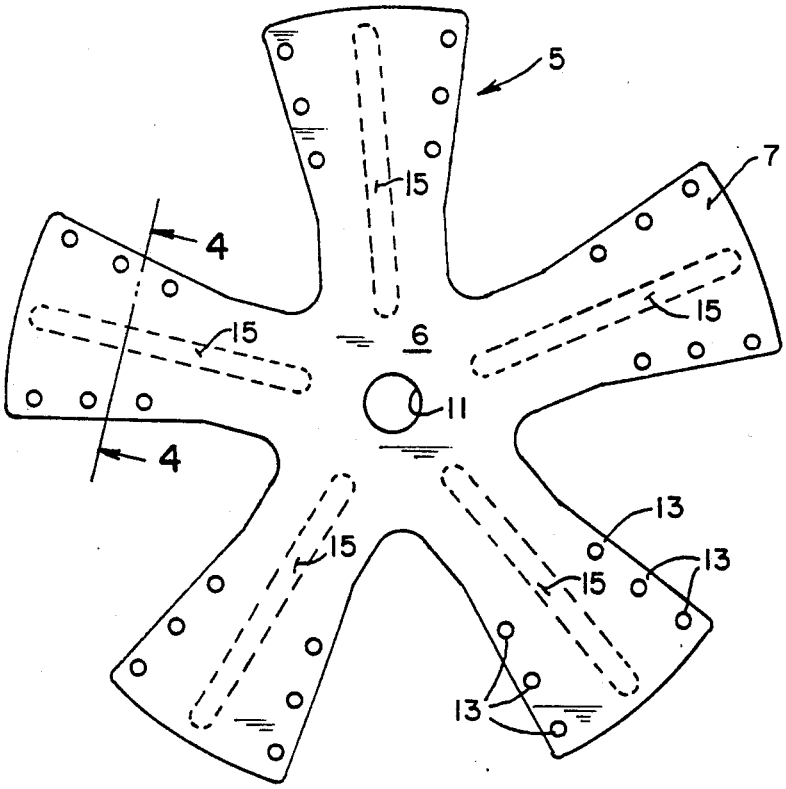
FIG. 3 is a top plan view of a flat spider plate of the fan assembly.
Figure 4:
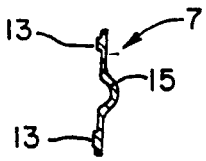
FIG. 4 is a cross-sectional view along line 4—4 of FIG. 3.
Figure 5:
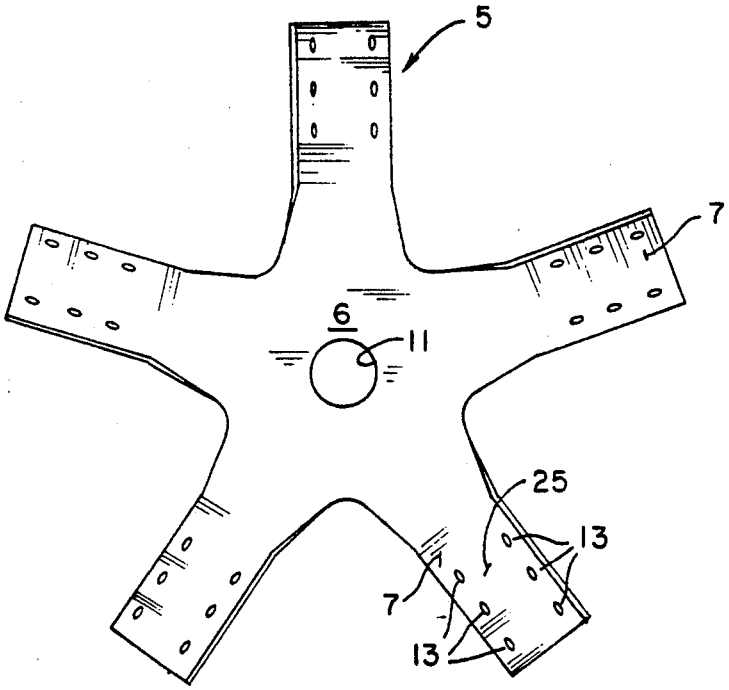
FIG. 5 is a top plan view of a formed spider plate.
Figure 6:
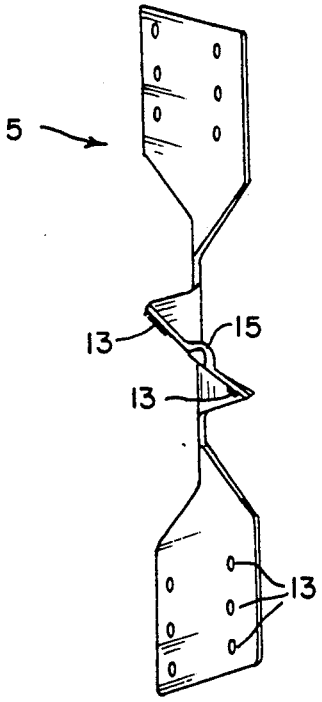
FIG. 6 is a side elevational view of the spider plate of FIG. 5.

The spider 5 may be a unitary piece, or, the arms 7 may be manufactured separately and later attached as to the spider plate 6. Spider 6 has hole 11 formed in the center of it. Hole 11 is aligned with the center of hub 3. The hub 3, in turn is mounted in a motor shaft, not shown, in applicational use. As will be appreciated by those skilled in the art, fan assembly 1 maybe directly driven by its associated motor, or it may be driven by the motor through some other mechanical arrangement. A belt and pulley works well, for example. In the belt and pulley construction, the shaft to which fan assembly 1 is attached is independently mounted remotely of the motor shaft. As seen in FIG. 3, spider arms 7 may be flat. They are preferably formed as in FIGS. 5 and 6 to conform to the curvature and pitch angle of the blades 9. As seen in FIGS. 3–6, arms 7 include projections 13 and a rib 15. The projections 13 and ribs 17 preferably protrude from opposite faces of arms 7.

Figure 7:
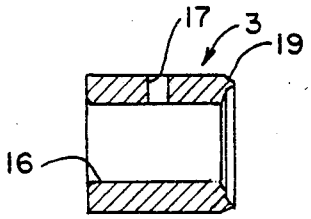
FIG. 7 is a cross-sectional view of an annular hub of the fan assembly.

Hub 3, best seen in FIG. 7, is annular, having a center aperture 16 which fits over the shaft of the associated motor so that the fan 1 may be rotated. Hub 3 includes a screw hole 17 which receives a set screw (not shown) to fixedly secure hub 3 to the shaft and an axial projection 19 forming one end face of hub 3. The projection 19 engages spider plate 6. Projection 19, as is explained below, is arc welded to the spider plate 6 when assembling the fan assembly 1.

Figure 9:
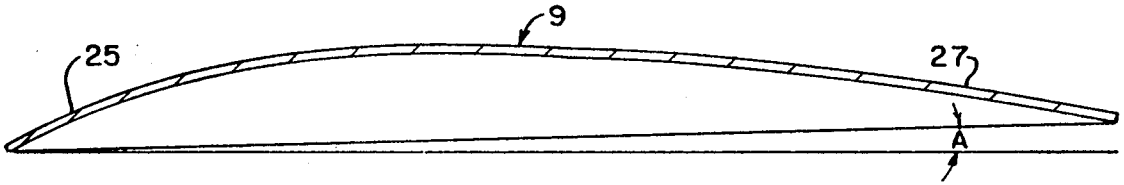
FIG. 9 is a cross-sectional view of the fan blade.

The design of the blade is important for blade performance. The preferred profile, one section of which is shown in FIG. 9, changes continuously along the radius of the fan. This configuration was determined by testing many variables which affect blade performance and fan efficiencies. These variables include blade shape, number of blades, blade camber, blade pitch, and blade tip pitch. Efficiencies are also effected by the clearance between the blade tip and the venturi and the blade root and the hub. The use of vane guides and multi-stage blades were also investigated. Tests were conducted to determine the effect of these parameters. The results are discussed below.

TABLE I

COMPARISON OF AIR FOIL BLADE WITH CONSTANT RADIUS BLADE

| Pitch Angle | CFM | Static Pressure No Air | % NT | Blade Type |
|---|---|---|---|---|
| 15° | 5226 | 0.223 | 56.1 | Circular# |
| 15° | 5616 | 0.238 | 44.4 | Air Foil* |
| 20° | 6472 | 0.289 | 48.3 | Circular |
| 20° | 6809 | 0.304 | 57.8 | Air Foil |
| 25° | 7909 | 0.367 | 57.9 | Circular |
| 25° | 7731 | 0.360 | 58.8 | Air Foil |
| 30° | 8297 | 0.380 | 52.2 | Circular |
| 30° | 8453 | 0.383 | 59.3 | Air Foil |

#Constant radius blade, ¼" camber, 8.5" wide
*¼" Camber, 8.5" wide blade

The comparison of the blade shapes was run with a two blade assembly. The circular (constant radius) blade has a profile symmetric about its centroid. The air foil shaped blade, as is explained below, is a combination of two radii or curves, a smaller curve and a larger curve, the larger curve forming the trailing edge of the blade. Both blades had a constant width. The test shows that efficiency was better for the air foil shaped blade at all pitch angles.

The increased efficiencies for the air foil blade is believed to be caused by the relative rates of acceleration and deceleration of air as it passes over the blade. When the blade passes through the air, it splits the air. Some of the air travels along the top, and some travels along the bottom. Since the air passing along the top of the blade has a longer distance to travel, it has an increased velocity. The velocity of the air increases till it reaches the top of the blade and then decreases as it travels down the trailing edge. If the decrease in velocity occurs over a very short distance, air separation and vortices may form on the top surface of the blade. By moving the center of curvature forward (toward the leading edge), as in the air foil shaped blade, the air has a longer distance in which to decrease its velocity, producing less separation, fewer vortices, and therefore, increased efficiency.

TABLE II

EFFECT OF BLADE TIP WIDTH ON FAN EFFICIENCY

| Blade Tip Type | CFM | Static Pressure | % NT. | Pitch Angle | Blade Profile |
|---|---|---|---|---|---|
| NARROW | 5232 | 0.173 | 33.4 | 20° | Flat 1* |
| WIDE | 5700 | 0.228 | 40.6 | 20° | Flat 2# |
| NARROW | 6115 | 0.218 | 30.4 | 25° | Flat 1 |
| WIDE | 6505 | 0.262 | 32.8 | 25° | Flat 2 |
| NARROW | 6243 | 0.232 | 25.7 | 30° | Flat 1 |
| WIDE | 7581 | 0.283 | 36.9 | 30° | Flat 2 |
| NARROW | 8019 | 0.423 | 41.3 | 20° | Air Foil 1 |
| WIDE | 7683 | 0.462 | 41.0 | 20° | Air Foil 2 |

TABLE II-continued

EFFECT OF BLADE TIP WIDTH ON FAN EFFICIENCY

| Blade Tip Type | CFM | Static Pressure | % NT. | Pitch Angle | Blade Profile |
|---|---|---|---|---|---|
| NARROW | 9158 | 0.435 | 46.2 | 25° | Air Foil 1 |
| WIDE | 9134 | 0.486 | 47.7 | 25° | Air Foil 2 |
| NARROW | 1056 | 0.452 | 51.8 | 30° | Air Foil 1 |
| WIDE | 10316 | 0.479 | 50.8 | 30° | Air Foil 2 |
| NARROW | 11720 | 0.448 | 53.3 | 35° | Air Foil 1 |
| WIDE | 11805 | 0.441 | 56.8 | 35° | Air Foil 2 |

*Flat 1: flat blade having 8.5" root, 4.25" tip
#Flat 2: flat blade having 4.25" root, 8.5" tip
**Air Foil 1: Air foil blade having 4.5" root, 6" tip, ⅛" camber
Air Foil 2: Air foil blade having 6" root, 4.5" tip, ⅛" camber Tests were run to determine the effect of blade tip and root configuration. The tests indicated that for the flat blade, a wide tip gave better efficiencies than a narrow tip by up to 10%. With the airfoil type blades, the effect of a wide tip vs. a narrow tip did not vary by more than 1%. However, for a pitch angle of 35°, the wide tip showed a better efficiency (by 3.5%). It was previously determined that the air foil blade is preferred (Table I). Because there is no significant difference between the wide and narrow tipped air foil blade, the wide root is preferred because it is structurally better than a narrow root.

TABLE III

EFFECT OF BLADE NUMBER ON FAN EFFICIENCY

| Number Of Blades | Pitch Angle | CFM | Static Pressure | % NT. |
|---|---|---|---|---|
| 4 | 25° | 8954 | 0.389 | 52.8 |
| 4 | 30° | 9988 | 0.574 | 51.0 |
| 4 | 35° | 10884 | 0.381 | 51.5 |
| 5 | 25° | 9258 | 0.439 | 51.8 |
| 5 | 30° | 10644 | 0.437 | 56.3 |
| 5 | 35° | 11516 | 0.420 | 55.2 |
| 6 | 25° | 9134 | 0.486 | 47.4 |
| 6 | 30° | 10316 | 0.479 | 50.8 |
| 6 | 35° | 11805 | 0.441 | 56.8 |

The effect of the number of blades on fan efficiencies was tested for various pitch angles. For the five and six blade fan assemblies, efficiencies generally increased as the pitch angle increased. For the four blade fan assemblies, the opposite was true. Thus, five or six blade fan assemblies are preferred to four blade assemblies. Further, it was found that five blade assemblies have generally better efficiencies than six blade assemblies over the range tested. Thus, five blade assemblies are preferred to six blade assemblies.

TABLE IV

EFFECT OF CAMBER ON FAN EFFICIENCY

| Camber Depth (in) | Camber Ratio (% of chord) | Pitch Angle | CFM | Static Pressure | % NT |
|---|---|---|---|---|---|
| 0.500 | 6.0 | 30° | 10834 | 0.699 | 44.7 |
| 0.625 | 8.0 | 30° | 10540 | 0.693 | 46.5 |
| 1.000 | 12.5 | 30° | 11217 | 0.725 | 36.0 |
| 0.500 | 6.0 | 35° | 12058 | 0.703 | 47.2 |
| 0.625 | 8.0 | 35° | 11545 | 0.696 | 50.7 |
| 1.000 | 12.5 | 35° | 12634 | 0.713 | 42.4 |
| 0.500 | 6.0 | 40° | 13391 | 0.689 | 48.3 |
| 0.625 | 8.0 | 40° | 13182 | 0.677 | 52.4 |
| 1.000 | 12.5 | 40° | 14177 | 0.699 | 45.4 |

As camber increased from 0.5" to 1.0" (6.0% to 12.5% camber ratio), CFM free air delivery increased by about 5%, but required more power which resulted in the decreased efficiency of the 1" camber over the 0.5" camber. The camber ratio is preferably between 7% -9%. A 0.625" camber (8% camber ratio) gave the highest efficiencies and is thus preferred.

TABLE V

EFFECT OF BLADE PITCH ANGLE ON FAN EFFICIENCY

| Pitch Angle | CFM | Static Pressure | Eff. % F.A. | Eff. MAX % | Blade Width Type | Number Of Blades |
|---|---|---|---|---|---|---|
| 25° | 9677 | 0.522 | 42.7 | 56.1 | Constant* | 6 |
| 30° | 10853 | 0.509 | 47.7 | 57.1 | Constant | 6 |
| 35° | 12161 | 0.479 | 50.9 | 56.2 | Constant | 6 |
| 40° | 13157 | 0.446 | 51.5 | 53.1 | Constant | 6 |
| 25° | 8954 | 0.389 | 52.9 | 63.6 | Variable# | 4 |
| 30° | 9988 | 0.404 | 51.0 | 58.8 | Variable | 4 |
| 35° | 10884 | 0.381 | 51.5 | 57.7 | Variable | 4 |
| 40° | 11284 | 0.369 | 51.9 | 51.9 | Variable | 4 |

*Constant: Air foil shaped blade, ½" camber, 8.5" wide
#Variable: Air foil shaped blade, ⅛" camber, 4.5" root, 6" tip The effect of pitch angle was tested for a constant width and a varying width blade, both of which were air foil type blades an for varying number of blades. As can be seen, for each set, fan efficiencies increased as the pitch angle increased form 25° to 30° and decreased from 35° to 40°. Pitch angles of between 30° and 35° produced the best results. Later testing showed that pitch angles of between 27.5° and 30° produced the best results for depitched blades (pitch angle decreasing from blade root to blade tip).

TABLE VI

EFFECT OF BLADE NUMBER AND DEPITCH RATE ON FAN EFFICIENCY

| Blade* | # of Blades | CFM Free Air | Static Pressure No Air | Efficiency Free Air | Efficiency Max | Depitch Rate (°/in) |
|---|---|---|---|---|---|---|
| 1 | 6 | 11970 | 0.472 | 53.5 | 59.5 | 1.00 |
| 2 | 6 | 11811 | 0.575 | 47.7 | 55.3 | 1.00 |
| 2 | 5 | 12057 | 0.540 | 50.3 | 55.0 | 1.00 |
| 3 | 6 | 12321 | 0.555 | 47.6 | 53.6 | 1.25 |
| 4 | 5 | 11950 | 0.530 | 50.6 | 55.4 | 1.25 |
| 4 | 5 | 12400 | 0.503 | 53.8 | 57.0 | 1.50 |
| ACME | 6 | 11600 | 0.532 | 51.0 | 61.0 | 1.00 |

*1: Steel blade having depitch rate of 1°/inch.
2: Aluminum blade having depitch 8% camber, 8.4" root, 6" tip
3: Aluminum blade having depitch 8% camber, 8.4" root, 6" tip
4: Aluminum blade having depitch 8% camber, 8.4" root, 6" tip
Acme: Commercially available blade used as a comparison The above results show that at a depitch rate of 1.00°/inch, five blade assemblies produce a higher output, but have a lower efficiency than with six blade assemblies. The opposite is true for a depitch rate of 1.25°

/inch. It also shows that a depitch rate of 1.5° /inch produces better efficiencies and that static pressure at shut off is higher with six blade assemblies than with five blade assemblies.

TABLE VII

EFFECT OF BLADE TIP PITCH ALONG BLADE RADIUS ON FAN EFFICIENCY

| Blade Tip Pitch | Amount Of Depitch (°/in) | CFM | Static Pressure | % NT. | % NT |
|---|---|---|---|---|---|
| 25°* | 1.0° | 10711 | 0.490 | 50.6 | 62.5 |
| 25° | 1.0° | 10840 | 0.513 | 49.4 | 58.0 |
| 25° | 2.5° | 12050 | 0.431 | 49.6 | 55.7 |
| 25° | 3.0° | 12271 | 0.390 | 52.7 | 57.5 |
| 30°* | 1.0° | 11971 | 0.472 | 53.5 | 59.5 |
| 30° | 1.0° | 11932 | 0.473 | 51.3 | 56.1 |
| 30° | 2.5° | 13103 | 0.400 | 52.1 | 54.9 |
| 30° | 3.0° | 13189 | 0.357 | 53.1 | 56.1 |
| 35°* | 1.0° | 13432 | 0.429 | 54.3 | 57.3 |
| 35° | 1.0° | 13101 | 0.451 | 50.8 | 52.3 |
| 35° | 2.5° | 13983 | 0.352 | 49.7 | 52.5 |
| 35° | 3.0° | 13988 | 0.310 | 51.3 | 52.5 |

*Tests for blades having a rear dyhedral angle

The effect of blade tip pitch was tested for a constant radius blade. The results showed that CFM free air delivery increased both as the tip pitch angle increased and as the depitch angle increased. The blades with a rear dyhedral angle showed very little change in CFM free air delivery as compared to a blade with no dyhedral angle. Static pressure at shut off decreased for all blades as the pitch angle increased. Lastly, efficiency at free air and maximum efficiency was consistently higher for blades with a 3° /inch depitch rate. However, efficiency was even greater for the dyhedral angle at free air. The relatively high test results show that the blade should have a variable pitch across the radius in order to obtain better performance.

Fans are often surrounded by a venturi 32 (FIG. 15). There is preferably a small gap 34 between blade tip 33 and the venturi. The width of the gap can effect fan efficiencies.

TABLE VIII

EFFECT OF BLADE TIP CLEARANCE ON FAN EFFICIENCY

| Blade Pitch | CFM | S.P. | % NT. | Tip Gap | Blade Type | Blade # |
|---|---|---|---|---|---|---|
| 20° | 7910 | 0.367 | 57.7 | ⅜" | Circular# | 2 |
| 20° | 7894 | 0.358 | 53.8 | ¼" | Circular | 2 |
| 20° | 7986 | 0.354 | 47.3 | ⅛" | Circular | 2 |
| 25° | 7731 | 0.360 | 58.8 | ⅜" | Air Foil* | 2 |
| 25° | 7920 | 0.362 | 54.0 | ¼" | Air Foil | 2 |
| 20° | 7030 | 0.463 | 45.6 | ⅜" | Air Foil | 3 |
| 20° | 7548 | 0.488 | 56.5 | ¼" | Air Foil | 3 |
| 25° | 8416 | 0.541 | 57.8 | ⅜" | Air Foil | 3 |
| 25° | 8901 | 0.566 | 57.4 | ¼" | Air Foil | 3 |
| 30° | 9238 | 0.538 | 56.0 | ⅜" | Air Foil | 3 |
| 30° | 9253 | 0.566 | 60.5 | ¼" | Air Foil | 3 |

#Constant radius blade, ⅛" camber, 8.5" wide
*⅛" Camber, 8.5" wide blade

The above table illustrates that ¼" to ⅜" tip clearance between the blade and the venturi has better efficiencies (5–7%) over ⅛" gaps. The lower efficiencies of the ⅛" tip clearance may be due to friction between the air boundary layers and the venturi. The ¼" to ⅜" tip clearance is approximately 1% of the fan diameter. Thus, the gap is preferably about ¼" for 24–36" fans and 5/16" for 42" or 48" fans.

The spider arm 7 is preferably twisted to pitch the blade. (FIGS. 5 and 6) This results in a gap 36 between the blade root 29 and spider plate 6. (FIG. 16) Better efficiencies are produced when the gap is small.

The gap may be reduced by, for example, cutting a slot around the spider arm. The slot may be a full slot 38, a curved slot 39, a stepped slot 40 or there may be no slot, as shown in FIGS. 13A–13D. However, it was found, through testing, that best efficiencies are produced when there is no slot as opposed to the designs that attempt to block the gap. Test results are tabulated below.

TABLE IX

EFFICIENCIES FOR ROOT GAP REDUCING BLADES

| Test | CFM Free Air | Watts Free Air | CFM ⅛" | Watts ⅛" |
|---|---|---|---|---|
| Full Slot | 9973 | 510 | 7269 | 530 |
| Curved Slot at Trailing Edge | 10049 | 505 | 7259 | 520 |
| No Slot | 10145 | 515 | 7440 | 530 |

The efficiencies were analyzed by calculating the ratio between the performances of the three configurations. Efficiency is calculated by the formula below:

$$Eff = \frac{CFM \times \text{total pressure}}{\text{Pressure} \times \text{Watts} \times \text{Constant}}.$$

Thus, the ratio of efficiencies is:

$$\frac{Eff1}{Eff2} = \frac{CFM1 \times P1 \times W2}{CFM2 \times P2 \times W1}.$$

Therefore, $$\frac{Eff_{no\ slot}}{Eff_{curved\ slot}} = \frac{10145 \times 0.117 \times 505}{10049 \times 0.113 \times 515} = 1.025$$

and $$\frac{Eff_{no\ slot}}{Eff_{full\ slot}} = \frac{10145 \times 0.117 \times 510}{9973 \times 0.113 \times 515} = 1.043.$$

TABLE X

EFFECT OF REAR VANE GUIDE ANGLE ON FAN EFFICIENCY

| Vane Width | CFM | % NT | Vane Angle |
|---|---|---|---|
| 8" | 11584 | 56.5 | 90° |
| 8" | 11741 | 55.3 | 80° |
| 8" | 11873 | 53.8 | 70° |
| 8" | 11897 | 53.0 | 60° |
| 8" | 11843 | 50.2 | 50° |
| 8" | 11679 | 48.1 | 40° |
| 8" | 11776 | 49.1 | −45° |
| 8" | 11847 | 49.5 | −50° |
| 8" | 11879 | 50.8 | −55° |
| 8" | 11858 | 51.9 | −60° |
| 8" | 11851 | 52.2 | −65° |
| 6" | 11727 | 51.8 | −65° |
| 6" | 11736 | 52.2 | −60° |
| 6" | 11700 | 55.8 | −70° |
| NONE | 11536 | 56.2 | NONE |

Vane guides were studied to determine their effect on CFM free air delivery and overall efficiency. Vane guides were made of flat sheets 14.5" long by 6" or 8" wide. As can be seen, the efficiency with a vane guide was greater than without a vane guide only at an angle of 90°, and then, the efficiency increased by only 0.3%. Thus, the fan preferably does not have a vane guide.

TABLE XI

EFFECT OF MULTI-STAGE BLADES ON FAN EFFICIENCY

| Hub Spacing | Hub Angle | Pitch Angle | CFM | Static Pressure | % NT |
|---|---|---|---|---|---|
| BUTT | BUTT | 30° | 9488 | 0.352 | 48.5 |
| BUTT | 15° | 30° | 9819 | 0.300 | 44.3 |
| BUTT | 30° | 30° | 9945 | 0.335 | 45.6 |
| BUTT | 45° | 30° | 10098 | 0.421 | 47.2 |
| BUTT | 60° | 30° | 10111 | 0.506 | 47.1 |
| 1" | BUTT | 30° | 9748 | 0.424 | 48.9 |
| 1" | 15° | 30° | 9928 | 0.359 | 45.5 |
| 1" | 30° | 30° | 10027 | 0.345 | 47.0 |
| 1" | 45° | 30° | 10117 | 0.409 | 50.9 |
| 1" | 60° | 30° | 10032 | 0.486 | 45.1 |
| 2" | BUTT | 30° | 9985 | 0.489 | 49.0 |
| 2" | 15° | 30° | 9950 | 0.417 | 47.1 |
| 2" | 30° | 30° | 10098 | 0.406 | 48.0 |
| 2" | 45° | 30° | 10132 | 0.411 | 46.7 |
| 2" | 60° | 30° | 10117 | 0.439 | 44.9 |
| 3" | BUTT | 30° | 9976 | 0.481 | 46.8 |
| 3" | 15° | 30° | 10098 | 0.438 | 46.7 |
| 3" | 30° | 30° | 10230 | 0.429 | 46.1 |
| 3" | 45° | 30° | 10235 | 0.431 | 48.7 |
| 3" | 60° | 30° | 10080 | 0.446 | 51.7 |
| —* | — | 30° | 10645 | 0.437 | 56.3 |

*Single hub, six blade fan used for comparison

To test the effect of multi-stage blades, two hubs 3a and 3b were assembled on one shaft. (FIG. 17) Three blades 9 were placed on each hub. The blades were arced blades, their curved edges facing outwardly (FIG. 19). The rear hub 3b was rotated at 15° increments, producing an angle H between the blades, for different hub spacings (FIG. 18). The pitch angle was set at 30 to avoid interference between blades. The results were compared with a six blade single hub fan. As can be seen, CFM and efficiency increased as the hub angle approached 60°. Neither the CFM nor efficiency changed significantly as the hubs were separated. The CFM and efficiency produced by the multi-stage blade never exceeded the CFM or efficiency of the single hub blade with which it was compared.

The preferred blade shape was determined from the forgoing tests. Turning to FIGS. 9-12, the profile of blade 9 is a combination of two arcs: a smaller arc 21, and a larger arc 23. Arc 21 forms the leading edge 25 of the blade and arc 23 forms the trailing edge 27. The arcs combine to give the blade an air foil type shape, which improves performance.

Figure 8:
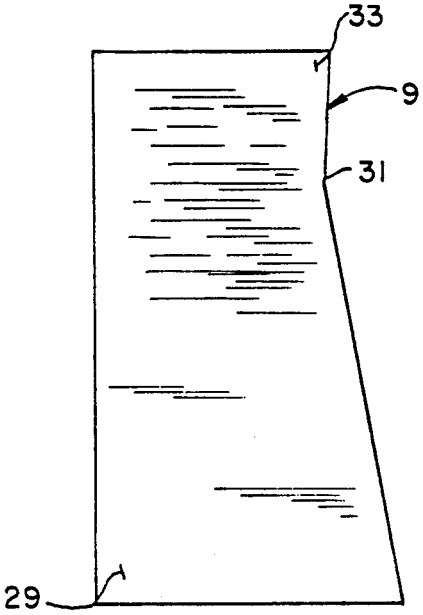
FIG. 8 is a plan view of a fan blade.

At any section, the profile of the fan blade is determined from the blade chord (blade width), L, the blade pitch angle, A, and the camber or blade depth, C. Preferably, the blade chord decreases approximately 0.15"/inch from the root 29 of the blade 9 to the ear 31 and then increases from the ear 31 to the tip 33 of blade 9 at a rate of approximately 0.177"/inch. (FIG.8) Blade pitch angle A preferably decreases from root 29 to tip 33 at a rate of approximately 1.5° /inch. The camber is preferably kept constant at approximately 8% of the chord length. Lastly, at any cross-section, arc 21 constitutes approximately ⅓ of the blade profile and arc 23, approximately ⅔ of the blade profile.

Figure 10:
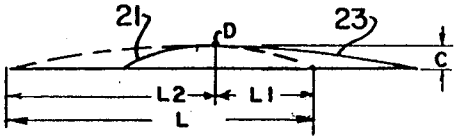

To determine the profile of the blade at any section, the length of a chord, L, at a section, i, is determined. The cord $L_i$ is divided into thirds to create lengths $L1_i$ which is $1/3L_i$ and $L2_i$ which is $2/3L_i$. At the junction of $L1_i$ and $L2_i$ the camber, or depth of the blade, is determined, creating a point D a length $C_i$ above cord $L_i$ (FIG. 10). Arcs 21 and 23 are then drawn through point D, point D being the center of the arcs. Arcs 21 and 23 have radii respectively of:

$$R1_i = \frac{4L1_i^2 + 4C^2}{8C_i}$$

$$R2_i = \frac{4L2_i^2 + 4C^2}{8C_i}$$

Figure 11:
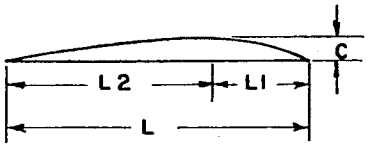

The undesired portions of the arcs, drawn in dotted lines in FIG. 10, are discarded to give the profile of FIG. 11. The blade is then rotated around its leading edge 25 by an angle $A_i$ to give the appropriate pitch at that section. Angle $A_i$ is increased preferably by 1.5° /inch of blade length.

Arms 7 of spider 5 arc preferably formed to match the pitch of blades 9 at their roots 29. Further, the arms 7 are preferably rotated along their axis, toward their leading edges, by approximately 5°. It has been found that this increases the efficiency of the fan 1 by about 2% as can be seen from the table below:

| Test | CFM Free Air | Eff. Free Air | CFM ⅛" | Eff. ⅛" |
|---|---|---|---|---|
| Blade Set Along Spider Arm | 12263 | 48.1 | 10245 | 55.3 |
| Blade Set 5% Off From Spider Arm Axis | 12122 | 49.3 | 10194 | 57.1 |

The better efficiencies produced by the tilted blade are believed to be result from the longer leading edge which is produced by tilting the blade forward.

The hub 3 is fastened to the spider plate 6 by arc welding. Other fastening methods are compatible with the broader aspects of the invention.

The blade 9 is secured to spider arm 7 at a fastening area 35 defined by projections 13 on arm 7. The fastening area is chosen to minimize the torsion load caused by the blades' centrifugal forces and the offset between the blade center of gravity and the centroid.

Figure 14:
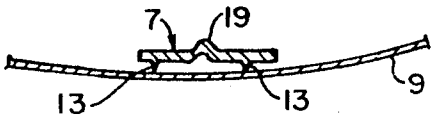
FIG. 14 is a cross-sectional view showing projection welding of the fan blade to the spider plate.
Figure 13D:
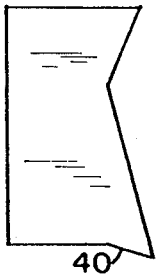
FIGS. 13A–13D show alternative blade embodiments which reduce a gap between the hub and the blade.
Figure 13C:
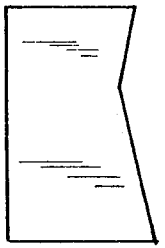
Figure 13B:
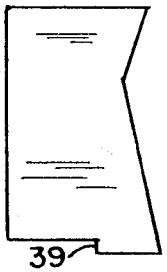
Figure 13A:
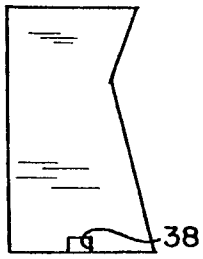
Figure 12:
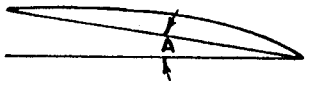
FIGS. 10–12 show the process of determining the shape of the fan blade.

Turning to FIG. 14, blade 9 is preferably projection welded to spider arm 7. Projection welding is similar to ring welding, except that discrete projections 13 are used as electrodes rather than an annular ring. Projections 13 are preferably conically shaped, with a ¼ diameter and a 1/32" height. Projection welding is preferred over the present method of riveting because the welding time is shorter—six or eight welds can be made at once.

In a comparison of ¼" diameter orbital rivets and ¼" diameter projection welds, which is tabulated below, it was found that the welds exceed rivets in their ability to withstand shear stresses by an average of 500 lbs. Rivets did exceed welds in their ability to withstand tension loads. However, blades are exposed to much higher shear loads than tension loads, due to the relatively high rate of rotation at which fans are operated.

TABLE XII

Comparison Of Projection Welds And Rivets

| Attachment type | Max Break Load | Min Break Load | Ave Break Load | Test type | Material | |
|---|---|---|---|---|---|---|
| rivet | 1443 | 1372 | 1397 | tension | 7/14 | CRS |
| weld | 4435 | 3610 | 3800 | tension | 7/14 | CRS |

TABLE XII-continued

Comparison Of Projection Welds And Rivets

| Attachment type | Max Break Load | Min Break Load | Ave Break Load | Test type | Material | |
|---|---|---|---|---|---|---|
| rivet | 1416 | 1320 | 1369 | tension | 10/16 | CRS |
| weld | 3175 | 1620 | 1673 | tension | 16/10 | CRS |
| rivet | 2110 | 1445 | 1942 | tension | 12/16 | CRS |
| weld | 2765 | 1563 | 1908 | tension | 16/12 | CRS |
| weld | 2260 | 2240 | 2250 | tension | 14/7 | Galv |
| weld | 2258 | 1958 | 2104 | tension | 16/10 | Galv |
| weld | 1732 | 1541 | 1637 | tension | 16/12 | Galv |
| weld | 3655 | 3060 | 3446 | shear | 7/14 | CRS |
| rivet | 2360 | 1992 | 2163 | shear | 7/14 | CRS |
| weld | 4075 | 3830 | 3928 | shear | 16/10 | CRS |
| rivet | 2470 | 1909 | 2217 | shear | 16/10 | CRS |
| weld | 3780 | 3470 | 3622 | shear | 16/12 | CRS |
| rivet | 2580 | 1898 | 2242 | shear | 16/12 | CRS |
| weld | 5415 | 4670 | 5109 | shear | 14/7 | GALV |
| weld | 3410 | 2870 | 3264 | shear | 10/16 | GALV |
| weld | 3115 | 2735 | 3006 | shear | 12/16 | GALV |

The blade may be balanced by adding correcting weights to desired blades at a specified radius to overcome any unbalance. Unbalance is generally due to non-uniform material thickness or to the eccentricity of the hub around the blade shaft.

Fans have natural modes or frequencies. If operated at these frequencies, the blades will fail due to excessive vibration. The blades have two modes, a flapping or bending mode and a torsion or twisting mode. The first or bending mode is at about 29 Hz and the second or twisting mode is at about 54 Hz on a 36" blade. The second mode remains constant during operation. However, the first mode may shift upwardly by 0–10%. The modes may be shifted by increasing the width of the spider arm and by increasing the depth of rib 15. The trapzoidal shape of the spider arm will raise the second mode, thus insuring that the fan will not be operated at its blade pass frequency. Further, if the fan is operated by a ⅓ Hp motor, it is unlikely that the fan will be operated at the first or second modes, thereby reducing the possibility of blade failure. Spider arm rib 15 is preferably about ¼" high.

Tests were conducted to compare life spans of various methods of constructing fan assemblies. The life time test was conducted by placing a 1.5 oz. weight at 16" on a 36" blade assembly to introduce an excitation force. The force increased the severity of the life test to obtain failures in a shorter time.

The blade is limited to a maximum of 0.1" in.oz. unbalance, as determined by the blade weight and its maximum rated RPM. By adding a 1.5 oz. unbalance at 16", the unbalance is magnified 24 times. Thus, for example, a blade life expectancy of twenty years is accelerated to about one year.

The tests showed that the ring weld and the root of the spider arm are the weak point in which a crack started and which propagated till the blade failed. This failure of the ring weld is due to the resistance of the high torsion loads resulting from the twisting mode. Once the crack started, it moved toward the center of the spider, encountered the ring weld, and separated the spider plate from the hub. The lack of fusion between the hub and spider combined with the excessive vibrations are believed to have caused the failure. Projection welds, on the other hand result in better fusion and thus a better weld. Therefore, longer assembly lives can be expected from projection welding the assembly together. Test results are shown in Table XIII below.

TABLE XIII

Effect of Blade Unbalance on the Blade-Spider Attachment and the Spider-Hub Attachment

| Test No. | blade-spider attachment | hub-spider weld | first mode Hz (RPM) | second mode Hz (RPM) | blade freq. Hz (RPM) | blade pass freq. Hz (RPM) | operation |
|---|---|---|---|---|---|---|---|
| 1 | rivet | arc | 27 (1620) | 55 (3300) | 56.7 (680) | 56.7 (3250) | Operated at 680 RPM for 5 months, 13 days. No failure because operated 1.7 Hz above the second mode |
| 2 | projection | ring | 29 (2620) | 54.4 (3300) | 10.8 (680) | 54.1 (3400) | Operated at 650 RPM, where blade pass frequency is coincident with the sec-and mode. Blade failed after 3 wks. Failure occurred at spider arm and spread to hub weld. |
| 3 | projection | ring | 28.4 (1704) | 53.5 (3210) | 11.2 (670) | 55.8 (3350) | day 1: 670 RPM<br>day 9: lower to 655 RPM, high noise developed<br>day 17: RPM lowered to 635.<br>day 45: failure |
| 4 | projection | ring | 32.5 (1950) | 52.8 (3168) | 10.1 (607) | 50.5 (3030) | day 1: 605 RPM<br>day 7: 620 RPM<br>day 14: 635 RPM<br>day 43: 605 RPM, moved away from second mode to allow for continuous operation without failure |
| 5 | projection | ring | 27 (1620) | 53.5 (3210) | 7.08 (425) | 35.4 (2125) | operated at 425 RPM - no failure after 27 days |
| 6 | bolted | arc | 26 (1560) | 55.8 (3348) | 11.08 (665) | 55.4 (3325) | operated at blade freq/. coincident with second mode. No failure after 16 days |

The die used to form the prototype blades is a slice die 51. The die is made of flat sheets of metal 53, laser cut to follow a predetermined pattern. Each slice 53 includes an upper portion 55 and a lower portion 57. When the pieces are assembled together (FIG. 20) the shape of the blade is reproduced. The slice die creates blade profiles that are smoother than blades formed with a press brake. The slice die does not allow for a high blade fabrication rate but produces more consistent blades than does a press brake. Further, by increasing or decreasing the number of slices in the die, blades for different venturi diameters can be made from the same slice die.

The slices 53 which make up the die are preferably made of 12 ga. steel. The 12 ga. steel was chosen because it is structurally strong, and thus will not buckle under pressure and it is thin enough (about 10 slices per inch) to allow small changes in blade shape without leaving step marks on the blade. Each slice of the die has a slightly different curvature to accommodate for the small change in blade profile and are slightly rotated with respect to each other by the specified depitch rate. The slices are assembled by forming holes 58 in the slices and passing rods 59 through the holes. The holes are cut so that when the slices are assembled, the die will have the appropriate depitch rate. Upper and lower sections 55 and 57 of the die are then held together by a pair of channels 61 and 63 which are connected by nuts and bolts.

The die can be formed to allow for forming blades having different depitch rates. By placing a series of holes 58 in the slices (FIG. 22) which are offset from each other, the same slices can be used to form blades of varying depitch rates.

Numerous variations, within the scope of the appended claims, will be apparent to those skilled in the art in light of the foregoing description and accompanying drawings.

We claim:

1. A fan assembly comprising an annular hub which fits over a motor axle to rotate therewith, a spider fixed to said hub, said spider having a plurality of arms, and a plurality of fan blades fixed to said spider arms having a root section and an ear section; said blade being in the form of an arc defining a chord which decreases along said root section and increases along said ear section, said blade having a blade depitch angle which decreases from the root to the top of said ear section and camber which is kept constant as a percent of said chord; said spider arms having a pitch angle to provide a pitch angle of between 22° -50° to said fan blades.

2. The fan assembly of claim 1 wherein said camber is from about 6% to about 12.5% of said chord.

3. The fan assembly of claim 1 wherein the blade depitch angle decreases at a rate of about 1.5° /inch to 3+ /inch.

4. The fan assembly of claim 3 wherein said blades have a pitch angle of between 22° -50° .

5. The fan assembly of claim 1 wherein the chord length decreases by about 0.15" per inch from the root to the ear section and increases by about 0.177" per inch along the ear section.

6. The fan assembly of claim 1, wherein said spider arms have a rib on one face extending the length thereof and a plurality of projections on another face.

7. The fan assembly of claim 6, wherein said spider arms are formed to match the pitch of said fan blades.

8. The fan assembly of claim 1 wherein said spider arms are rotated approximately 5° toward their leading edge.

9. A fan assembly comprising an annular hub which fits over a motor axle to rotate therewith, a spider fixed to said hub, said spider having a plurality of arms, and a plurality of fan blades fixed to said spider arms having a root section and an ear section; said blade being in the form of an arc defining a chord which decreases along said root section and increases along said ear section, the arc being defined by arcs of two circles, one arc defining ⅓ of the chord length, the other arc defining ½ the chord length; said blade having a blade pitch angle of between 22° -50° and a depitch angle which decreases from the root to the top of said ear section and camber which is kept constant as a percent of said chord.

10. An airfoil shaped fan blade having a root, a tip, an ear between said root and said tip, and a leading edged and a trailing edge, the distance between said edges defining a chord, said chord decreasing from said root to said ear at a rate of about 0.15"/inch of blade length and then increasing from said ear to said tip by about 0.177"/inch of blade length.

11. An airfoil shaped fan blade having a root, a tip, an ear between said root and said tip, and a leading edged and a trailing edge, the distance between said edges defining a chord, said chord decreasing from said root to aid ear and then increasing from said ear to said tip; said airfoil shape being defined by a first arc, which defines said leading edge, and a second arc which defines said trailing edge; said fan blade having a constant camber ratio.

12. The fan blade of claim 11 wherein said camber is about 6%-12.5% of the chord.

13. The fan blade of claim 12, wherein said arcs have radii, said radii changing along the length of aid blade, said radii being a function of said camber and said chord length.

14. An airfoil shaped fan blade having a root, a tip, an ear between said root and said tip, and a leading edge and a trailing edge, the distance between said edges defining a chord, said chord decreasing from said root to said ear and then increasing from said ear to said tip; said blade having a pitch which decreases along the length thereof at a rate of about 1.5°/inch to 3°/inch.

15. An airfoil shaped fan blade having a root, a tip, an ear between said root and said tip, and a leading edged and a trailing edge, the distance between said edges defining a chord, said chord decreasing from said root to said ear and then increasing from said ear to said tip; said blade having a pitch which decreases along the length thereof; said blades have a pitch angle of between 25°-40°.

* * * * *

UNITED STATES PATENT AND TRADEMARK OFFICE

CERTIFICATE OF CORRECTION

PATENT NO. : 5,246,343
DATED : September 21, 1993
INVENTOR(S) : Jim Windsor, et al It is certified that error appears in the above-indentified patent and that said Letters Patent is hereby corrected as shown below:

Column 2, Line 18, delete "preferably" and insert -- Preferably --
Column 3, Line 31, delete "illustrates" and insert -- illustrative --

Column 4, Line 68, delete "Airfoil 1" and insert -- Airfoil 1* --
Column 4, Line 68, delete "Airfoil 2" and insert -- Airfoil 2# --
Column 12 in Table XIII in Test 2 under 29, delete "2620" and insert -- 1620 --
Column 13, Line 48, delete "3+/inch" and insert -- 3°/inch --
Column 14, Line 14, delete "1/2" and insert -- 2/3 --
Column 14, Line 31, delete "aid" and insert -- said --
Column 14, Line 39, delete "aid" and insert -- said --

Signed and Sealed this

Sixth Day of December, 1994

*Attest:*

Bruce Lehman

BRUCE LEHMAN

*Attesting Officer*

*Commissioner of Patents and Trademarks*